United States Patent [19]

File

[11] Patent Number: 4,596,357

[45] Date of Patent: Jun. 24, 1986

[54] MAILBOX SIGNALING DEVICE

[76] Inventor: Robert H. File, P.O. Box 3006, Albuquerque, N. Mex. 87190

[21] Appl. No.: 699,474

[22] Filed: Feb. 8, 1985

[51] Int. Cl.[4] ..... A47G 29/12

[52] U.S. Cl. ..... 232/35; 232/17

[58] Field of Search ..... 232/34, 35, 17

[56] References Cited

U.S. PATENT DOCUMENTS

| | | | |
|---|---|---|---|
| 3,080,107 | 3/1963 | Lindahl | 232/35 |
| 3,272,465 | 9/1966 | Baarsgard | 232/35 |
| 3,750,939 | 8/1973 | Hallett | 232/35 |
| 3,904,108 | 9/1975 | File | 232/35 |
| 3,958,752 | 5/1976 | Pieszchala | 232/35 |
| 4,147,292 | 4/1979 | Fisher | 232/34 |
| 4,205,778 | 6/1980 | File | 232/35 |

*Primary Examiner*—Gene Mancene
*Assistant Examiner*—David I. Tarnoff
*Attorney, Agent, or Firm*—Harvey B. Jacobson

[57] ABSTRACT

A mailbox signaling device comprises a pivotal plate on the base of a mailbox which is raised from a prominently exposed position below the box to a substantially invisible position flush with the base of the mailbox when mail is delivered into the box. Accordingly, the plate may give the impression when it is exposed that it is in a signaling position, although the box is actually empty, and when mail is delivered, the plate is invisible and no signal is therefore evident, except to persons familiar with the workings of the device, that mail has been delivered into the box.

5 Claims, 3 Drawing Figures

MAILBOX SIGNALING DEVICE

BACKGROUND OF THE INVENTION

This invention relates to mailbox signals of the kind which may be employed, for example, in connection with rural and like mailboxes that are situated at a distance from a dwelling or the like, to provide a visible signal of when mail has been delivered, so that an occupant of the dwelling need only make a trip to the mailbox to collect mail when the appropriate signal is visible. Mailbox signal devices commonly comprise a movable flag or like signaling element which, when mail is delivered to the box, is moved from one position to another which denotes the presence of mail in the box. Commonly, the signaling element is moved from a less prominent position to a more prominent position for signaling the presence of mail in the box.

One objection to signaling devices of the above nature is that in providing a prominent signal to a householder of the presence of mail in a box, a device may at the same time provide a like signal to a potential thief who is acquainted with the signaling arrangement. The present invention is directed toward overcoming this objection. More particularly, the invention provides a modification in mailbox signaling devices of the general type disclosed in applicant's earlier U.S. Pat. No. 4,205,778, wherein a signaling element in the form of a pivotal plate is attached to the base of a mailbox for lowering movement from a less prominent elevated position flush with the base of the box to a more prominent vertical signaling position below the box under the control of a cord which hooks onto the mailbox door so that when the door is opened by a mail carrier to deliver mail, the cord is released thereby allowing the plate to drop into its signaling position.

STATEMENT OF PRIOR ART

Applicant is aware of the following U.S. patents, the relevance of which is that they relate to mailbox signaling devices and the like. None of the patents, however, discloses the concept or structure of the present invention.

2,352,975
2,815,167
3,331,552
3,958,752
4,073,430
4,205,778

SUMMARY OF THE INVENTION

In accordance with the present invention, in a mailbox signaling device, control means is provided for moving a signaling element from a more prominent position into a less prominent, preferably invisible, position responsive to the delivery of mail into the box. Accordingly, for persons who are unaccustomed to the workings of the device, no evident signal is given of when mail has been delivered into the mailbox. This will make theft from the box less likely, particularly in areas where there are a number of mailboxes equipped with more conventional signaling devices.

As applied to a mailbox signaling device having a signaling element in the form of a pivotal plate mounted on the base of the box as in applicant's above noted prior patent, the plate is adapted to be raised from its lowered vertical position to a position substantially flush with the base of the box in which the plate is substantially invisible, responsive to the delivery of mail into the box. Thus, when the plate is in the lowered visible position, the box is in fact empty, and when the box has had mail delivered, the plate is substantially invisible so that no evident signal is provided (except to persons familiar with the working of the device), that mail is present in the box.

To provide the required movements of the signaling plate, a control cord may be attached to the plate, the cord extending through a pair of supports, such as eyebolts, internally of the mailbox for trapping of a free end of the cord between the mailbox door and the body of the box, and with the cord being provided with a weight between the supports. When the free end of the cord is released into the box, the weight drops, pulling on the length of cord between the weight and the pivotal plate, thereby raising the plate flush with the base of the box. When the free end of the cord is pulled outwardly and trapped between the mailbox door and frame, however, the weight is raised thereby providing slack in the length of cord between the weight and the pivotal plate, allowing the plate to fall into the lowered visible position.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF PREFERRED EMBODIMENT

Figure 1:
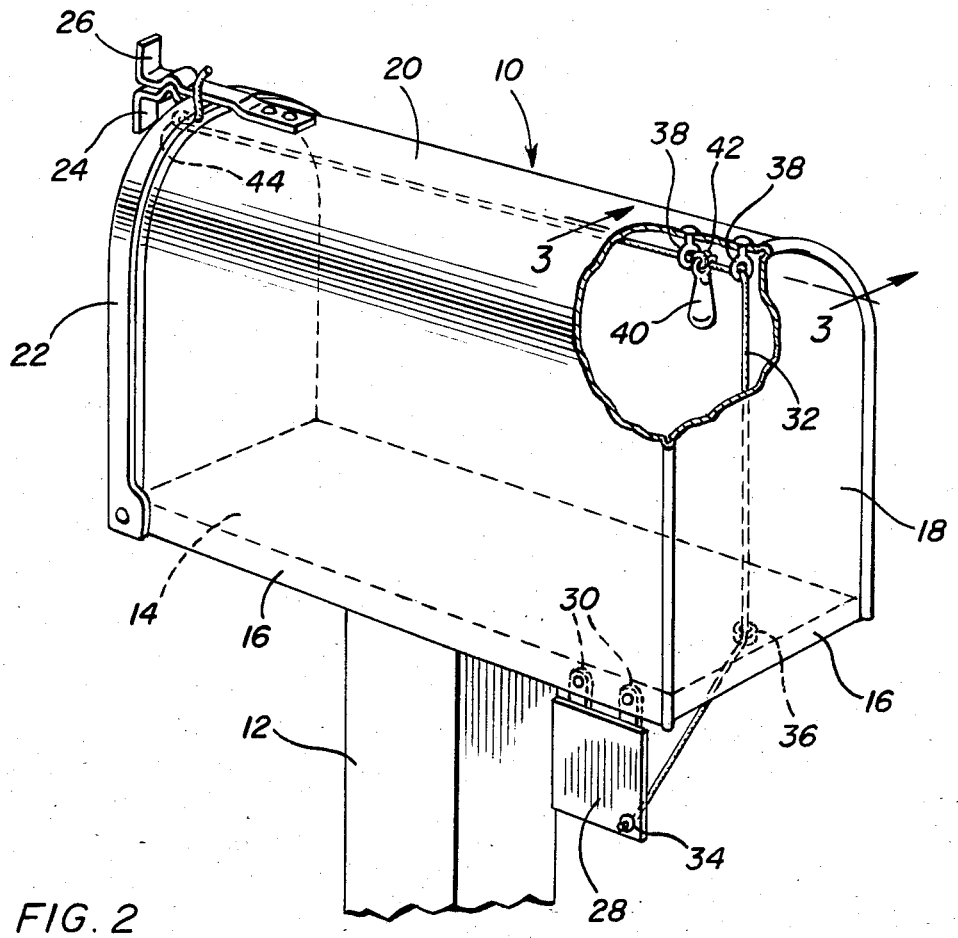
FIG. 1 is a perspective view, part broken away, of a mailbox equipped with a signaling device in accordance with the invention, with a signaling element shown in a first position.

A conventional form of mailbox 10 is shown in the drawings mounted atop a support post 12. The mailbox may be made of metal sheet or the like having a base wall 14 with a peripheral flange 16, a rear wall 18, an arched body-forming wall 20, and a pivoted access door 22. Cooperating clips 24, 26 are provided on the door and on the front of wall 20 to retain the door in closed position, in known manner.

In accordance with the invention, the mailbox is provided with a signaling element in the form of a plate 28 pivotally connected to flange 16 by cord or like hinges 30, so that the plate can be moved between a raised substantially invisible position (FIG. 2) in which it is substantially flush against the bottom surface of base wall 14, and a lowered vertical position (FIG. 1) in which it is prominently displayed below the mailbox.

Movements of the plate 28 between the above positions is provided by a cord 32 having one end secured to the plate at 34, the cord extending into the mailbox interior through a hole 36 in base wall 14, and through a pair of eyebolt supports 38 riveted or similarly secured inside the top of wall 20. Further, a weight 40 is secured to the cord between the eyebolts, for example by a knot 42 in the cord.

When the cord is released (FIG. 2) weight 40 drops towards the base of the mailbox thereby pulling on the portion of cord between the weight and the plate 28 so as to raise the plate into its invisible position flush with base wall 14. The length of the cord is such, however, that its free end 44 can be pulled outwardly and trapped between door 22 and the forward edge of wall 20 (FIG. 1) thereby raising the weight toward the eyebolts and providing slack in the portion of cord between weight 40 and plate 28. Accordingly, the weight of plate 28 causes it to drop into its vertical visible position.

Figure 2:
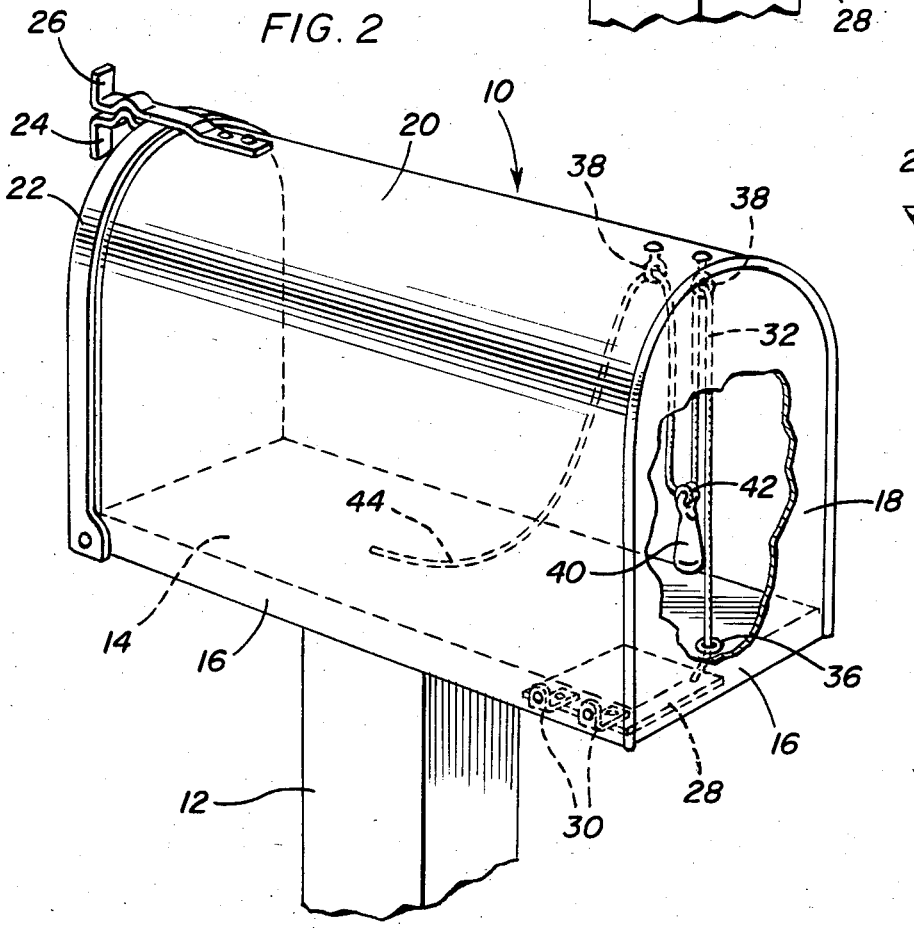
FIG. 2 is a view similar to FIG. 1 with the signaling element shown in a second position.
Figure 3:
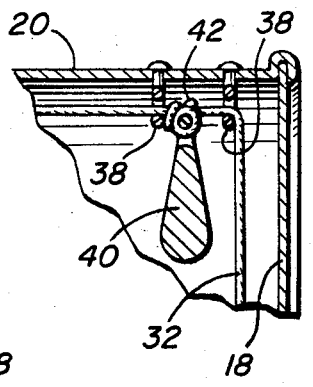
FIG. 3 is an enlarged sectional view on line 3—3 of FIG. 1.

When a householder or like user of the box has collected delivered mail from the box, the householder traps the cord between the box door and frame as in FIG. 1, causing plate 28 to drop into its visible position which may give an impression to persons familiar with conventional signaling devices that the plate is in signaling position, but actually denoting to persons familiar with the device that the box is, in fact, empty. Then, when a mail carrier opens the door to deliver mail, the cord is released thereby raising plate 28 to its invisible FIG. 2 position. Thus, when the box contains mail, no evident signal is given of its presence, except to persons familiar with the workings of the signaling plate.

Control of plate 28 between the described positions can be effected by alternative means to the illustrated cord and weight mounting system, and in the illustrated embodiment, the eyebolt cord supports could be mounted on the rear wall 18 rather than on wall 20.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A mailbox including a movable signaling element for denoting the presence and absence of mail in the box, and control means for moving the signaling element from a more prominently displayed position into a less prominently displayed position responsive to the delivery of mail into the mailbox, wherein the signaling element comprises a plate pivotally mounted on the mailbox for raising movement from the more prominent position to the less prominent position wherein the control means comprises a cord extending from the plate through a pair of spaced cord supports mounted on the mailbox, and a weight secured to the cord between the supports, the cord having a free end which can be trapped between a door of the mailbox and the mailbox body to raise the weight thereby creating slack in a portion of the cord between the weight and the plate allowing the plate to drop into the more prominent position, and opening of the mailbox door releasing the cord, allowing the weight to drop and providing a pulling force on said portion of the cord for raising the plate into the less prominent position.

2. The invention of claim 1 wherein the plate is disposed substantially vertically below the mailbox in the more prominently displayed position and is raised substantially flush with a base wall of the mailbox so as to be substantially invisible in the less prominently displayed position.

3. A mailbox including a signaling element in the form of a plate pivotally mounted on the mailbox exterior for movement between a raised less prominent position and a lowered more prominent position, and control means for moving the plate between said positions comprising a cord extending from the plate into the mailbox and through a pair of cord supports in the mailbox, and a weight secured to the cord between the supports, the cord having a free end which can be trapped between a door of the mailbox and the mailbox body to raise the weight thereby creating slack in a portion of the cord between the weight and the plate allowing the plate to drop into the lowered position, and opening of the mailbox door releasing the cord, allowing the weight to drop and providing a pulling force on said portion of the cord for lifting the plate to the raised position.

4. The invention of claim 3 wherein the plate is substantially flush with the base wall of the mailbox in the raised position and substantially vertically displayed below the mailbox in the lowered position.

5. A mailbox having a mail-delivery signaling plate pivotally mounted on the base of the mailbox for movement between a raised position in which the plate is substantially flush with a base wall of the mailbox and a lowered position in which the plate is displayed below the mailbox, and control means for moving the plate from the lowered position to the raised position responsive to the delivery of mail into the box, wherein the control means comprises a cord extending from the plate into the mailbox, a pair of cord supports with at least one of said cord supports in the mailbox, and a weight secured to the cord between said supports, the cord having a free end which can be trapped between a door of the mailbox and the mailbox body for raising the weight thereby creating slack in a portion of the cord between the weight and the plate allowing the plate to drop into the lowered position, and opening of the mailbox door releasing the cord allowing the weight to drop and providing a pulling force on said portion of the cord for lifting the plate to the raised position.

* * * * *